United States Patent [19]

Freed

[11] Patent Number: 4,539,873

[45] Date of Patent: Sep. 10, 1985

[54] PRYER-PLIER TOOL

[76] Inventor: Melvyn N. Freed, 17023 Magnolia Dr., Hazel Crest, Ill. 60429

[21] Appl. No.: 556,406

[22] Filed: Nov. 30, 1983

[51] Int. Cl.[3] ..... B25B 7/02

[52] U.S. Cl. ..... 81/311; 7/127; 29/229; 29/243.56

[58] Field of Search ..... 81/302, 306, 305, 311; 7/125, 127; 29/229, 223, 243.56

[56] References Cited

U.S. PATENT DOCUMENTS

| | | | |
|---|---|---|---|
| 1,122,165 | 12/1914 | Schoening | 81/302 |
| 1,176,604 | 3/1916 | Sanders | 81/311 |
| 1,324,557 | 12/1919 | Landaw | 29/223 |
| 1,399,665 | 12/1921 | Shapiro | 7/130 |
| 2,483,383 | 9/1949 | Heimann | 81/302 |
| 2,616,315 | 11/1952 | Caldwell | 81/302 |
| 2,643,565 | 6/1953 | Mount | 81/302 |
| 2,792,622 | 5/1957 | Wurzel | 81/341 |
| 3,602,973 | 9/1971 | Mata | 29/268 |
| 3,760,473 | 9/1973 | Studdard | 7/125 |

FOREIGN PATENT DOCUMENTS

| | | | |
|---|---|---|---|
| 345110 | 2/1921 | Fed. Rep. of Germany | 7/127 |
| 948563 | 1/1949 | France | 81/302 |

*Primary Examiner*—Roscoe V. Parker

*Attorney, Agent, or Firm*—Allegretti, Newitt, Witcoff & McAndrews, Ltd.

[57] ABSTRACT

A multi use tool having a pair of links pivoted to one another by a pivot intermediate the ends, cooperating inwardly facing jaws adjacent one end of the links, the jaws operable toward one another to grip an object, separation jaws adjacent the opposite end of the links, a handle formation defined on each link between the jaws and the pivot and a spring for biasing the jaws apart and the separation jaws together, whereby squeezing the handle formation will move the jaw toward one another and the separation jaws away from one another.

9 Claims, 6 Drawing Figures

PRYER-PLIER TOOL

BACKGROUND OF THE INVENTION

The present invention relates to a multi use pryer plier tool having jaw means at both ends, a first jaw means being adapted to grip and/or squeeze objects to be held, and a second jaw means being adapted to open objects, for example, retaining rings or C-clamps.

The prior art discloses a variety of tools having one or more features of the present invention, but none having the construction and advantages of the present invention.

Landaw, U.S. Pat. No. 1,324,557 reveals a single use piston ring remover having a spring means adjacent the pivot which moves the flat face of a pair of jaws into engagement. There is no suggestion in Landaw of the multi use tool disclosed herein.

Shapiro, U.S. Pat. No. 1,399,665 discloses a combination tool for use by telegraph linemen and electricians generally to open and close the links of chains.

Heimann et al., U.S. Pat. No. 2,483,383 reveals a specific use tool for handling openended spring retaining means.

Caldwell, U.S. Pat. No. 2,616,315 discloses a single use C-ring applying and removing tool which has a U-spring between the links of the tool to bias a pair of cooperating jaws closed.

Mount, U.S. Pat. No. 2,643,565 pertains to expanding jaw pliers for removing clips from coil spring assemblies.

Wurzel, U.S. Pat. No. 2,792,622 reveals a circular spring removing tool having a single pair of cooperating jaws.

Mata, U.S. Pat. No. 3,602,973 reveals a brake shoe spreading hand tool.

Studdard, U.S. Pat. No. 3,760,473 discloses pliers having gripping jaws at one end and cooperating file teeth on the handles of the pliers to file away rough edges of pipe.

None of the above prior art discloses the specific combination tool disclosed herein, which is not only compact and can be made in a variety of sizes and shapes so as to handle objects both large and small, but is also relatively inexpensive to manufacture.

An object of the present invention is to provide a multi use pryer-plier tool that will open and close metal clamps and non-continuous rings of various types and sizes.

Another object of the present invention is to provide a multi use tool that comprises a pair of parallel pivoted links having separation jaws and gripping jaws, said tool being constructed and arranged for both prying objects and gripping objects so as to function both as a pryer and a plier. Other objects and advantages will become more apparent hereinafter.

BRIEF DESCRIPTION OF DRAWING

There is shown in the attached drawings presently preferred embodiments of the present invention, wherein like numerals in the various views refer to like elements and wherein.

DETAILED DESCRIPTION OF THE PRESENT INVENTION

Figure 1:
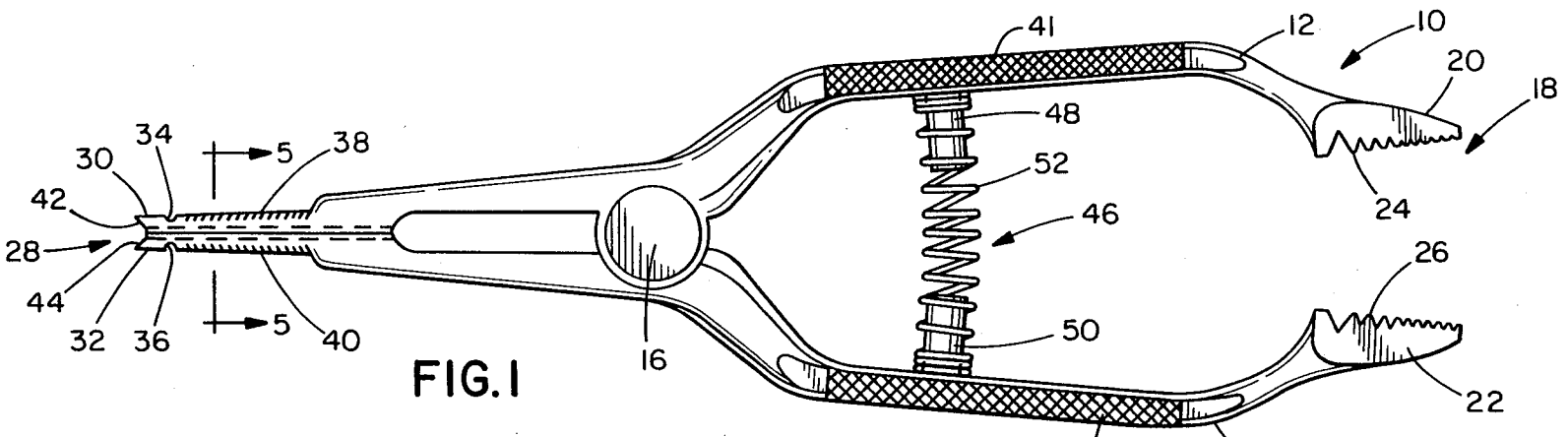
FIG. 1 is a plan view of a multi use tool embodying the present invention.
Figure 2:
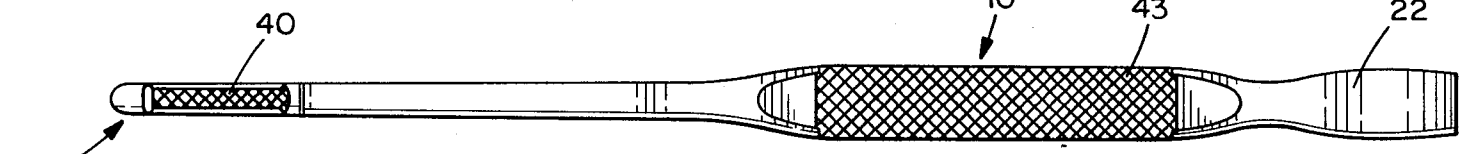
FIG. 2 is a plan view of the multi use tool of FIG. 1.
Figure 3:
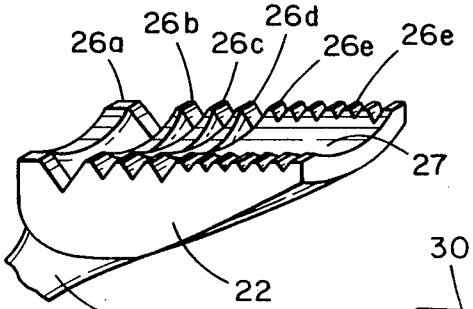
FIG. 3 is an enlarged perspective view of a gripping jaw of the multi use tool.

With reference to FIGS. 1 through 5, there is shown a presently preferred embodiment of the present invention. The multi use tool 10 comprises basically a pair of elongated links 12 and 14 secured together intermediate their lengths by pivot means 16. The elongated links 12, 14 are arranged in parallel relationship, rather than scissor relationship, as with a conventional plier tool. The pivot means 16 may comprise a rivet or screw arrangement lying within the height limitations of the links 12 and 14 so as to provide a streamlined appearance as viewed from the side (FIG. 2). Formed at the right end of the links as viewed in FIG. 1 are jaw means 18 for gripping an object. The jaw means 18 comprise a jaw 20 on link 12 and a jaw 22 on link 14. The cooperating inwardly facing jaw means 18 each have a plurality of teeth 24 and 26, respectively on the inner surfaces of the jaws 20 and 22, respectively. The jaws 20 and 22 are identical, but opposed or reversed from one another. The jaw 22 will be described with more particularity. As best seen in FIG. 3, the jaw 22 has a pair of teeth **26*a* and 26*b* spaced relatively far apart. A relatively large and deep recess is defined between teeth 26*a* and 26*b*. Teeth 26*b*, 26*c*, 26*d* and 26*e* are spaced somewhat closer together than the space between 26*a* and 26*b*. The recesses between teeth 26*b*, 26*c*, 26*d* and 26*e* are relatively smaller and shallower than the recess between teeth 26*a* and 26*b*. The spacing between each of teeth 26*e* is uniform and relatively close together. Preferably, each of the teeth is formed with a flattened top. The teeth on each jaw are arranged in a pair of longitudinally disposed parallel rows. A slightly concave surface 27 is defined between the adjacent rows of teeth on each jaw 20, 22**.

At the opposite end of the links from the jaw means 18, there are formed jaw means 28. The jaw means 28 function in an opposite fashion from the jaw means 18 and hence, define separation jaws. The jaw means 28 comprise separate jaws 30 and 32 which are provided on the curved exterior surfaces with notches 34 and 36, respectively, and with knurled or roughened surfaces 38 and 40, respectively. Furthermore, the ends 42 and 44 of the jaws 30 and 32 are formed as blunt chisels, sloping inwardly from the exterior end surfaces. The separation jaws 30 and 32 are adapted to be inserted within a retaining ring, for example, with the retaining ring in the recesses 34 and 36. The recesses 34 and 36 prevent slippage of the retaining ring or like member relative to tool 10. The jaws 30 and 32 may then be separated by squeezing the links 12, 14 to spread the retaining ring and remove it from engagement with an object.

Defined on the links 12 and 14, are handle portions 41 and 43. The handle portions 41 and 43 are located between the pivot means 16 and the jaw means 18. The handle portions 41, 43 are adapted to be squeezed together so as to selectively squeeze the jaw means 18 together or separate the separation jaws 28. Spring means 46 are placed between the links 12 and 14 to bias the links to the position shown in FIG. 1, with the separation jaws 28 closed and the jaw means 18 opened. The spring means 46 comprise a coil spring 52 operably affixed on the post 48 and 50. The posts 48 and 50 are secured to the links 12 and 14, and extend inwardly toward one another. The inner ends of the post 48 and 50 are spaced apart sufficiently so that they do not contact one another, even when the jaws 20 and 22 are closed and in contact with one another. The spring 52 is preferably in the form of a coil spring, with the ends disposed upon the post 48 and 50. It is not necessary that the spring ends be rigidly joined to the post 48 and 50 as, for example, by soldering. However, they can be so affixed, if desired.

The handle means 41, 43 are actually a portion of the links 12 and 14, respectively. The exterior surfaces of the links are curved in cross section and are roughened or knurled to facilitate gripping of the multi use tool 10 by the user. Alternatively, in larger size, heavier duty tools, the handle means 41, 43 may be formed with leather or plastic bound or otherwise secured to the links 12, 14 so as to better conform the handle means to the hand of a user.

Figure 5:
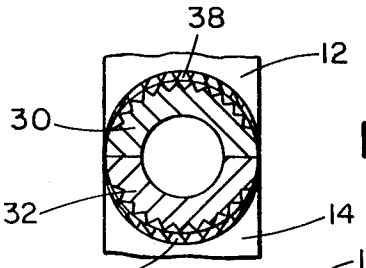
FIG. 5 is a cross-sectional view taken generally along the line 5—5 of FIG. 1.
Figure 4:
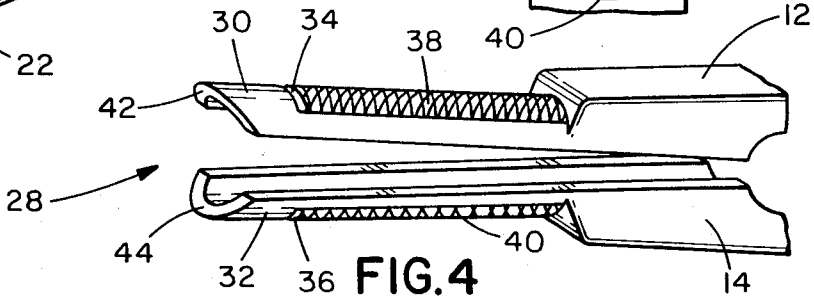
FIG. 4 is a perspective view of the separation jaws of the multi use tool of FIG. 1.

In FIGS. 4 and 5, there is better shown the separation jaw means 28 of the present invention. The ends 42 and 44 are formed in a chisel-like configuration and can be used to pry into the retaining ring or C-clamp to be spread apart. The separation jaws 28 may be formed integrally with the links 12 and 14 by conventional machining or appropriate manufacturing processes. The interior of each of the separation jaws 30, 32 is generally circular, as best shown in FIG. 5. The exterior surfaces of the separation jaws 30, 32 are preferably curved and tapered toward the end, as best shown in FIG. 1, to permit angled intrusion into an object to be opened. By knurling or roughening the exterior surface of the jaws 30 and 32, non-slipping engagement of an object to be pried or spread apart is enhanced.

It is to be observed that the links 12 and 14 are connected in parallel rather than crossed as in a conventional design of pliers. Thus in use, squeezing the handles 41 and 43 toward one another will close the jaw means 18 and open the separation jaws 28. The operator will utilize one jaw means or the other as desired.

The multi use tool 10 may be made in various sizes to accommodate a variety of uses. For example, it may be made in a very small size (on the order of three inches overall length) for jewelry repair and may be made in a larger size (on the order of eight inches overall length) for general use by a do-it-yourself user.

Figure 6:
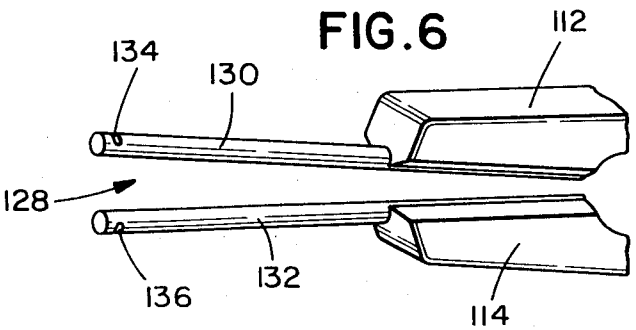
FIG. 6 is a detailed perspective view of modified separation jaws for the multi use tool.

With reference to FIG. 6, there is shown a modification of the separation jaws. The jaws 130 and 132 are adapted to be connected to the links 112 and 114. The links 112 and 114 are identical to the links 12 and 14 of FIG. 1, but for the means of affixing the separation jaws 128 to the links. The separations jaws 128 are shown in the form of elongated rod-like members 130 and 132 which are welded or otherwise suitably connected to the links 112 and 114. Provided on the jaws 130 and 132 are notches 134 and 136 for facilitating gripping engagement of the separation jaws with C-clamps, retaining rings or the like. The basic function of the embodiment of FIG. 6 is the same as that of the embodiment of FIG. 1, and it will be understood that the device of FIG. 6 may be in different sizes to accommodate different uses, for example, the rods 130 and 132 may be the diameter of a sewing needle for jewelry purposes.

There has been provided by the present invention a multi use pryer plier tool that has jaw means for providing a prying or opening function at one end and a plier or closing function at the other end. The separation jaws in the embodiment of FIG. 1 have tapered jaws with chisel ends. The outer surfaces of the separation jaws are curved, tapered, and knurled or cross hatched for non-slipping engagement with clamps and the like objects. The gripping jaws 18 are formed with a plurality of teeth in a particular spaced configuration to facilitate gripping engagement with a variety of objects. The longitudinally inward teeth are more sharply defined and spaced apart and the longitudinally exterior teeth are uniformly formed. If desired, all teeth can be uniform but for the most inward tooth *26a*. C-rings or like objects to be closed may be disposed at right angles to the jaws 20, 22 and retained in selected recesses between teeth 24, 26. Squeezing handles 41, 43 will squeeze the C-rings. Other objects may be oriented in the space between the rows of teeth on each jaw. Still other objects may be retained between the teeth 24, 26 on opposed jaws 20, 22. Thus, the gripping jaws 20, 22 are capable of handling a variety of sizes of C-clamps, retaining rings, or like objects.

One modification contemplates detachable separation jaws 28 of different sizes secured to a single set of links 12, 14. This modification will enhance the versatility of the present invention.

While presently preferred embodiments of the present invention have been shown and described, it will be understood that the invention may be otherwise embodied within the scope of the appended claims.

I claim:

1. A multi-use tool comprising a pair of links pivoted to one another by pivot means intermediate the ends, cooperating inwardly facing jaw means adjacent one end of the links, the jaw means having opposed teeth operative to grip an object when moved toward one another, cooperating separation jaws adjacent the opposite end of the links from the jaw means, the separation jaws being elongated and having chisel-like configurations at the outer ends, the separation jaws being adapted to abut one another, spring means for biasing the jaw means apart and the separation jaws together, and handle means defined on each link between the jaw means and the pivot means, whereby squeezing of the handle means will move the jaw means toward one another and the separation jaws away from one another.

2. A multi-use tool as in claim 1 wherein the separation jaws each include notch means on the exterior surface for facilitating engagement with a C-ring or the like object, which is spread to open and release same.

3. A multi-use tool as in claim 2 wherein the exterior curved surface of each of the separation jaws are roughened to facilitate non-slip engagement with an object.

4. A multi-use tool as in claim 1 wherein the teeth of the jaw means each have a flat-top.

5. A multi-use tool as in claim 4, wherein the jaw means comprises a pair of jaws and the teeth on each jaw are spaced relatively close together adjacent the outer end of the jaw and are spaced further apart longitudinally inward from the outer end of each jaw.

6. A multi-use tool as in claim 5 wherein each of the jaws of the jaw means has a longitudinally concavely curved interior surface for facilitating gripping of an object therebetween.

7. A multi-use tool as in claim 1, wherein the chisel-like configurations slope inward from the exterior end surfaces of each separation jaw.

8. A multi-use tool as in claim 1 wherein each separation jaw has a concavely curved interior surface for facilitating gripping of an object therebetween.

9. A multi-use tool comprising a pair of links pivoted to one another by pivot means intermediate the ends, cooperating inwardly facing jaw means adjacent one end of the links, the jaw means having opposed teeth operative to grip an object when moved toward one another, cooperating separation jaw means adjacent the opposite end of the links from the jaw means, the separation jaw means comprising elongated rod-like members, each of said members having at least one notch means for facilitating gripping engagement with an object, spring means for biasing the jaw means apart and simultaneously biasing the rod-like members, and elongated handle means defined on each link between the jaw means and the pivot means for facilitating use of the multi-use tool for a selected function, whereby squeezing of the handle means will move the jaw means toward one another to grip an object and will move the rod-like members away from one another to spread an object.

* * * * *